US005158206A

United States Patent [19]

Kobayashi et al.

[11] Patent Number: 5,158,206

[45] Date of Patent: Oct. 27, 1992

[54] AEROSOL CONTAINER CAP

[75] Inventors: Shinya Kobayashi, Tokyo, Japan; Tan S. Cheng, Kuala Lumpur, Malaysia

[73] Assignee: Tiram Kimia Sendirian Berhad, Kuala Lumpar, Malaysia

[21] Appl. No.: 865,775

[22] Filed: Apr. 13, 1992

Related U.S. Application Data

[63] Continuation of Ser. No. 552,914, Jul. 16, 1990, abandoned.

[30] Foreign Application Priority Data

Jul. 19, 1989 [MY] Malaysia ..... PI8900979

[51] Int. Cl.[5] ..... B65D 83/14

[52] U.S. Cl. ..... 222/39; 222/41; 222/153; 222/402.11

[58] Field of Search ..... 222/402.11, 402.13, 222/153, 182, 39, 41, 384

[56] References Cited

U.S. PATENT DOCUMENTS

| | | | |
|---|---|---|---|
| 2,772,819 | 12/1956 | Poarch et al. | 222/402.11 |
| 3,236,421 | 2/1966 | Glazier | 222/402.13 |
| 3,655,100 | 4/1972 | Markowitz | 222/182 |
| 3,744,682 | 7/1973 | Blank | 222/402.11 |
| 3,768,703 | 10/1973 | Markowitz | 222/182 |
| 3,770,168 | 11/1973 | Sagarin | 222/182 |
| 3,828,981 | 8/1974 | Linkletter . | |
| 3,831,804 | 8/1974 | Focht | 222/182 X |
| 3,863,814 | 2/1975 | Shelton | 222/153 |
| 3,870,187 | 3/1975 | Bennett | 222/153 X |
| 3,876,113 | 4/1975 | Trotta | 222/402.13 X |
| 3,908,958 | 9/1975 | Linkletter . | |
| 3,940,025 | 2/1976 | Anderson | 222/402.3 X |
| 3,963,152 | 6/1976 | Landsman et al. | 222/402.13 |
| 3,967,760 | 7/1976 | Marcon | 222/402.11 |
| 3,988,186 | 10/1976 | Anderson | 156/69 |
| 4,132,333 | 1/1979 | Debard | 222/402.13 |
| 4,166,554 | 9/1979 | Anderson | 222/182 |
| 4,171,758 | 10/1979 | Corba . | |
| 4,324,351 | 4/1982 | Meshberg . | |
| 4,418,842 | 12/1983 | DiLoreto | 222/182 X |
| 4,513,890 | 4/1985 | Goncalves . | |
| 4,542,837 | 9/1985 | Rayner | 222/402.13 X |
| 4,576,315 | 3/1986 | Vitale | 222/153 |
| 4,967,941 | 11/1990 | Beck | 222/153 |
| 5,027,982 | 7/1991 | Demarest | 222/182 |
| 5,085,347 | 2/1992 | Hayes et al. | 222/153 |

FOREIGN PATENT DOCUMENTS

| | | | |
|---|---|---|---|
| 1071588 | 2/1980 | Canada . | |
| 1136099 | 11/1982 | Canada . | |
| 1156986 | 11/1983 | Canada . | |
| 0041412 | 12/1981 | European Pat. Off. . | |
| 0062256 | 10/1982 | European Pat. Off. . | |
| 0119084 | 9/1984 | European Pat. Off. . | |
| 0244293 | 7/1989 | European Pat. Off. . | |
| 2509903 | 8/1975 | Fed. Rep. of Germany | 222/402.13 |
| 2207067 | 6/1974 | France . | |
| 2387168 | 11/1978 | France . | |
| 2486036 | 1/1982 | France . | |
| 2499524 | 8/1982 | France . | |
| 62-17364 | 2/1987 | Japan . | |
| 63-13805 | 4/1988 | Japan . | |
| 6110636 | 5/1988 | Japan . | |
| 6167862 | 9/1988 | Japan . | |
| 573568 | 6/1972 | Switzerland | 222/402.13 |
| 1390795 | 4/1975 | United Kingdom . | |
| 1558546 | 1/1980 | United Kingdom . | |
| 2078862 | 10/1983 | United Kingdom . | |
| 2136507 | 2/1986 | United Kingdom . | |
| 2233395 | 1/1991 | United Kingdom . | |
| 8706503 | 11/1987 | World Int. Prop. O. | 222/402.11 |

*Primary Examiner*—Donald T Hajec

*Attorney, Agent, or Firm*—David Newman & Associates

[57] ABSTRACT

A cap comprising of a cover (2) and a tubular body (1) for use on an aerosol can (5). The tubular body (1), fitted onto the aerosol can (5), contains a perpendicular bar (10), horizontal bar (6), ducts (30) to release the contents on the can. To activate the ejection valve stem (14), a lever mechanism is incorporated in the cover which can be disposed in an open and close position. In the open position, the upper portion of the cover (26) depressed, activates the ejection valve stem (14), releasing the contents. When upper portion of cover is moved to a close position, it is not possible to accidentally activate the ejection valve stem. Audible sound is created when the cover reaches the open and close position.

27 Claims, 3 Drawing Sheets

AEROSOL CONTAINER CAP

RELATED PATENTS

This application is a continuation of application Ser. No. 07/552,914, filed Jul. 16, 1990 now abandoned.

FIELD OF INVENTION

This invention relates to an aerosol container cap and more specifically, to certain new and useful improvements in the configuration and structure of an aerosol container cap for use in association with an aerosol container discharging gaseous or vapourised matter.

BACKGROUND OF THE INVENTION

Aerosol containers containing a wide variety of active components such as insect repellents, insecticides, hair sprays, creams or foams and so on have been marketed widely for household, commercial or industrial purposes.

In conventional aerosol containers, the ejection outlet is normally a tubular element which, when depressed into the body of the container releases the contents which are held under pressure. When the applied force at the valve stem is removed, the valve stem returns to its equilibrium position simultaneously stopping the outward flow of the contents of the container. In one type of aerosol containers a small knob (actuator) is fitted over the valve stem such that when the actuator is depressed the valve stem is simultaneously depressed causing the contents of the container to be released via an outlet in the actuator. Release of the pressure at the actuator returns the valve stem to its equilibrium position. Very often the contents of the aerosol container spill over onto the finger of the operator. To operate the actuator an enclosing cover has to be removed first to expose the actuator. Such covers can often be misplaced by the end-users.

In another type of aerosol container cap, the cap is designed with the actuator as part of its total structure whereby the release of the contents is done by depressing a certain part of the cap (trigger). The contents of the aerosol goes through a certain part of the cap. This is called a "spray through cap". However, in this type of cap the "trigger" is not protected from accidental pressing of the cap by the user. Although in this type of cap, the hand is not soiled by the spillage of the aerosol contents, the danger or inconvenience of accidental spraying of the contents is present.

OBJECTS OF THE INVENTION

It is therefore an object of the present invention to provide an aerosol container cap which can obviate the above described problems inherent in the conventional aerosol caps.

It is another object of the present invention to provide an aerosol container cap wherein the cap can be positioned in an operative or position analogous to an on and off position.

It is another object of the present invention to provide an aerosol container cap wherein the operative or inoperative position is easily attained by simple basic movements by the user.

It is still another object of the present invention to provide an aerosol container cap wherein the operative and inoperative position of the cap is easily identified by any user.

It is further object of the present invention to provide an aerosol container cap wherein the contents of the container do not come into physical contact with the hands of the user when the cap is used.

It is still another object of the present invention to provide an aerosol container cap wherein an audible sound indicator is provided to indicate when the cap is either in the operative or inoperative position.

SUMMARY OF THE INVENTION

An aerosol container cap comprising a tubular body and a cover member; the tubular body being mounted over the ejection valve stem of the aerosol container and having a diametrically positioned first bar pivoted at one end to the circumferential edge of the tubular body and a second bar connected to the first bar positioned and dimensioned to fit over the valve stem and the two bars having a continuous passage therethrough designed to permit flow of the aerosol contents into an aperture on the second bar and out through the pivoted end of the first bar; and a cover member mounted rotatably over the tubular body wherein the cover member includes resilient means for engaging on the free end of the first bar in an operative and inoperative position.

In one aspect of the invention the resilient means of the cover member includes a depressible portion pivotally mounted or hinged at one end to the cover member and actuator means on the underside at the free or loose end of the depressible portion to engage on the free end of the first bar in an operative position and disengage from the free end of the first bar in inoperative position.

In another aspect of the invention the tubular body is provided with at least two stoppers spaced a distance apart and the cover member includes reciprocal stopper means so as to restrict the radial movement of the cover member on the tubular body within a pre-determined radial angle.

It is still another aspect of the invention when the first of the two stoppers and the reciprocal stopper means are in contact, the actuator means on the cover member is in an engaged position on the free end of the first bar; and when the second of two stoppers and the reciprocal stopper means are in contact, the actuator means is in a disengaged position from the said free end of the first bar. The reciprocal stopper means includes an inward projecting lip from the circumferential edge of the cover member adjacent to the free end of the depressible portion.

In yet another aspect of the invention, audible means is included to provide an audible signal to the user indicating the moment the cap is ready for operating and the moment the cap is in an inoperative condition. The audible means comprises of two rigid flap projections integral with the tubular body and spaced apart on the circumferential edge of the tubular body and a corresponding rigid flap integral with the cover member projecting on the underside of the inner circumferential edge of the cover member, all flaps so dimensioned such that when the flap on the cover member passes over the flap on the tubular body at the moment the cap is ready for operating (open position) or in an inoperative condition (close position) respectively, an audible sound is produced by the frictional force.

The cap including all the various components parts is advantageously formed in a plastics composition.

In addition, the circumferential side surfaces of the cover member and tubular body are flushed when in position, thus resulting in a continuous smooth surface.

Additional objects and advantages of the invention will be set forth in part in the description which follows, and in part will be obvious from the description, or may be learned by practice of the invention. The objects and advantages of the invention also may be realized and attained by means of the instrumentalities and combinations particularly pointed out in the appended claims.

BRIEF DESCRIPTION OF THE DRAWINGS

The accompanying drawings, which are incorporated in and constitute a part of the specification, illustrate preferred embodiments of the invention, and together with the description serve to explain the principles of the invention.

DETAILED DESCRIPTION OF THE PREFERRED EMBODIMENTS

Figure 1:
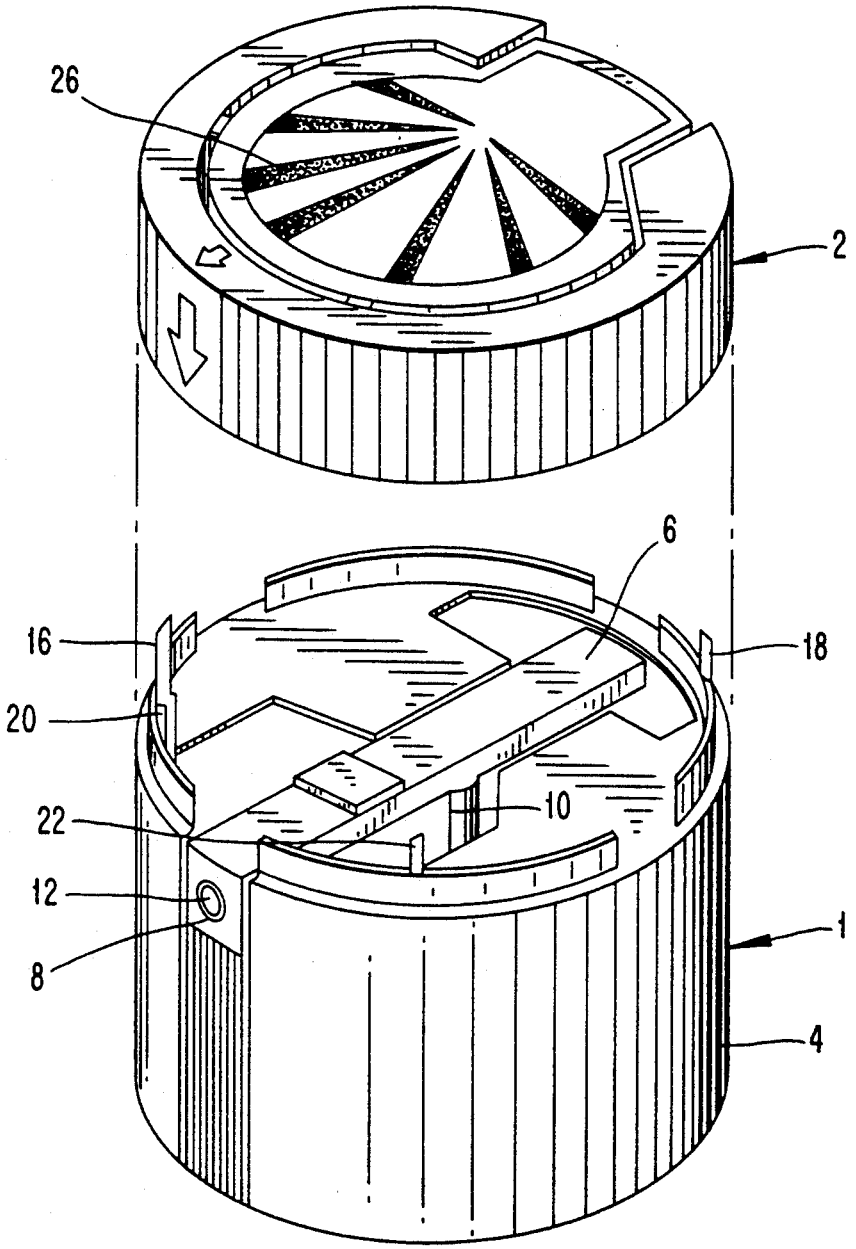
FIG. 1 is a perspective view of the cap (with the cover member and the tubular body apart) according to the invention.

Reference will now be made in detail to the present preferred embodiments of the invention, examples of which are illustrated in the accompanying drawings, wherein like reference numerals indicate like elements throughout the several views.

Figure 5:
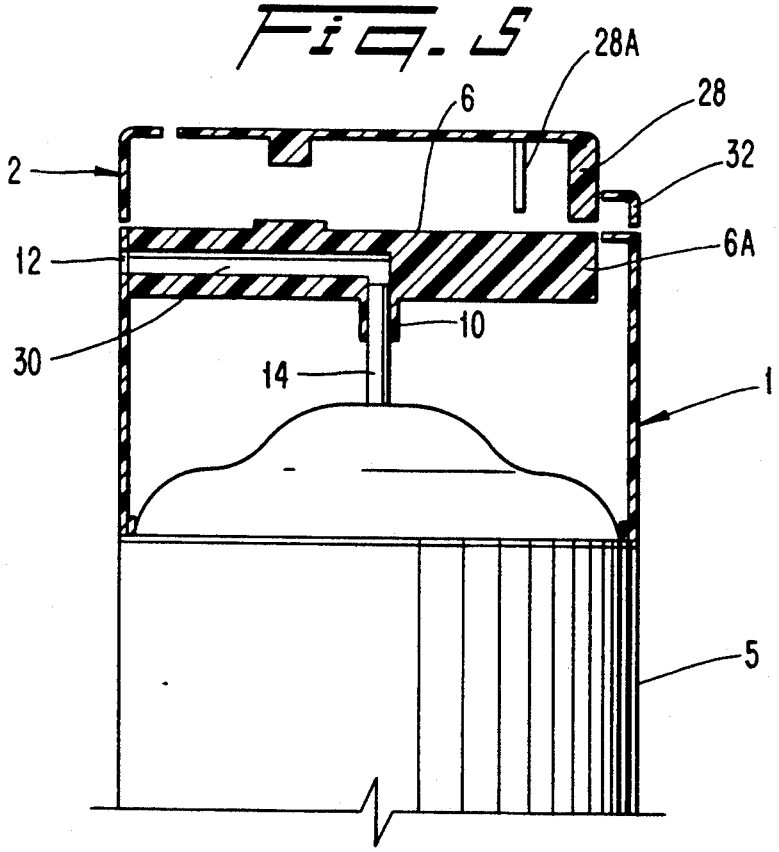
FIG. 5 is a across-section on the line X—X in FIG. 1 (the position of the valve stem and the top portion of the aerosol can are included for purpose of clarity).

The cap, as illustrated in FIG. 5, includes a tubular body (1) and a cover member (2). The tubular body (1) comprises a cylindrical body (4) the lower end of which is of conventional design to fit tightly over the top end of the aerosol can (5). The upper end of the tubular body includes a diametrically positioned T-shaped member comprising of a horizontal first bar (6) and a second bar (10). The first bar is securely pivoted or hinged at one end to the circumferential surface (8) of the tubular body. The second bar (10) is preferably integrally connected to the first bar and is so dimensioned to fit over the valve stem (14) of the aerosol can (5) in a loose fitting manner. The second bar is hollow and the free end of which is an inserted funnel shape to accommodate the valve stem of the aerosol can. One portion of the first bar (6) and the second bar (10) includes a continuous passage (30) therethrough to permit the flow of the aerosol contents. When the valve stem is depressed, the contents of aerosol can stored under pressure are released. The released contents are channelled through the aforesaid passage in the first and second bar to leave the passage via the orifice opening (12) at the pivotal end (8) of the first bar. By way of example only, household insecticides are one such material packed in aerosol container. When the valve stem is depressed, the insecticide is ejected out from the aerosol container. The ejected repellent is discharged through the orifice in a conical spray.

The valve stem is depressed preferably by depressing the second bar (10) by leverage means. This is achieved by depressing a distal end (6A) of the first bar hereinafter to be described.

The tubular body includes tongue and groove means (36) at the upper peripheral edge consistent with the tongue and groove means of the cover member. It is preferred that the tongue and groove means of the cover member be positioned on lower inner side of the cover member which configuration and design results in a smooth flushed surface when the cover member is fastened to the tubular body. The cover member (2) is snap fastened to the upper portion of the tubular body by means of the complimentary tongue and groove means. It will be understood by those skilled in the art that are other acceptable ways in which the cover member can be rotatably fastened to the tubular body.

It is a preferred embodiment of the present invention that the circular movement of the cover member in relation to the tubular body be restricted to a predetermined radial angle corresponding to the operative and inoperative position of the cover member (analogous to the open and close position). This is achieved in the preferred embodiment by the positioning two stoppers (16, 18) along the peripheral edge of the tubular body, one on each side of the first bar (6). In FIG. 1 the stoppers are positioned at the 1 o'clock and 7 o'clock positions relative to the direction of the first bar. The stoppers (16, 18) act in a reciprocal manner with the lip (32) of the cover member in a manner to be hereinafter described.

Figure 2:
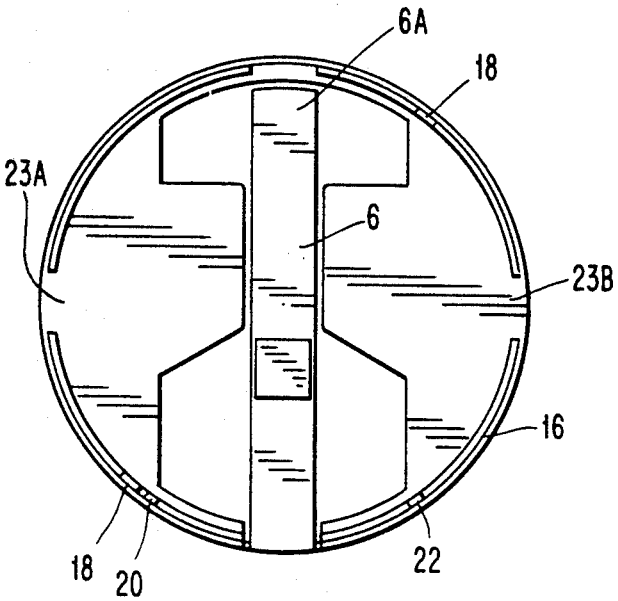
FIG. 2 is a plan view of the tubular body (lower cap) according to the invention.
Figure 2A:
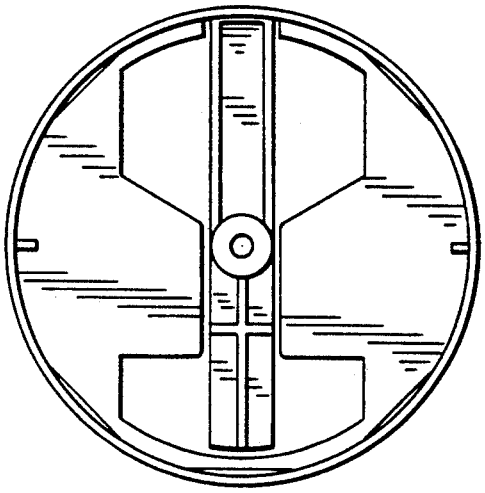
FIG. 2A is an underside plan view of the tubular body according to the invention.
Figure 3:
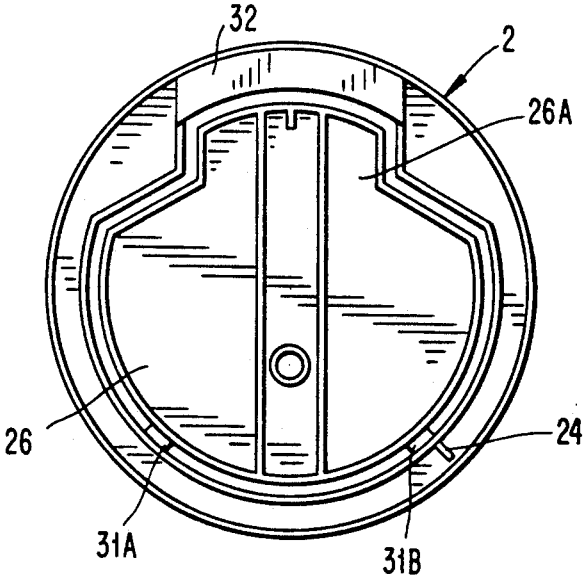
FIG. 3 is an underside plan view of the cover member (upper cap).
Figure 4:
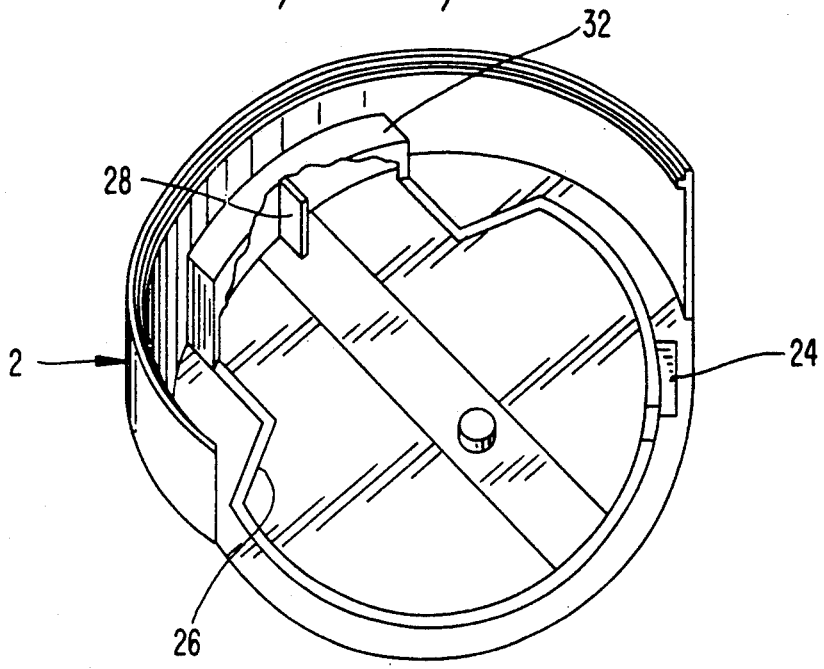
FIG. 4 is a perspective view of the inside of the cover member (upper cap).

To indicate to the user the operative and inoperative position of the cap there is provided audible means which produces an audible sound when the cover is moved to the operative position and when the cover is moved to the inoperative position when rotated. In the present embodiment two rigid flap projections (20, 22) are positioned, as illustrated in FIGS. 2 and 3, one on each side of the first bar (6) along the inner peripheral edge and adjacent to the tongue and groove means of the tubular body, preferably at 1 o'clock and 11 o'clock positions respectively relative to the direction of the first bar (6). The cover member (2) includes a underside fin (24) projecting on the underside of the inner circumferential edge. When the cover member is fastened to the tubular body, the underside fin (24) lies between the two rigid flaps (20, 22).

The fin (24) passes over the flap (20) when the cover member is in an inoperative position (closed position). When the cover is rotated to an operative position (open) the fin (24) now passes over the flap (22). Whenever the fin glides over the flaps an audible "click" sound is heard indicating the respective positions of the cover member.

The tubular body preferably further includes two shelf-like portions (23A, 23B) on either side of the first bar (6) substantially at the same level as the upper surface of the first bar. These shelf-like portions provide support and maintain the shape of the tubular body and also act as a opposing structure to the depressible portion of the cover member when the cap is in the inoperative position.

The cover member includes a depressible portion (26) substantially made out of the top surface of the cover. The depressible portion is pivoted or hinged at least one end. In the preferred embodiment the depressible portion is hinged at two points (31A, 31B), as illustrated in FIG. 3. Alternatively, one larger hinge can be provided to accomplish the same purpose. The depressible portion is resiliently malleable at the hinges such that after the downward force is removed, the depressible portion returns to its original equilibrium position. The free end of the depressible portion (26A) has a actuator means on the underside comprising of at least one overhanging flap (28), which flap is positioned above the distal end of the first bar (6) when the cover member is in an operative position. It is preferred that two overhanging flaps (28, 28A) be positioned above the distal end of the first bar (6) when the cover member is in an operative position. This will ensure that the actuator means always actuates the horizontal bar (6) when the depressible portion (26A) is pressed down.

The terminal end of the flap (28) ends marginally above the upper surface of the first bar (6). In this position a slight downward force applied at the free end of the depressible portion (26A) causes the overhanging flaps (28, 28A) to depress the distal end of the first bar (6) which in turn depresses the second bar (10) to press down the ejection valve stem (14), thus releasing the aerosol contents. The aerosol contents thus released is directed out via the orifice (12) through the continuous passage (30) in the portion of the first bar and the second bar. When the downward pressure at the free end of the depressible portion (26A) is removed, the depressible portion returns to the equilibrium position. Similarly, the first bar (6) and the ejection valve stem return to their respective equilibrium positions. The flow of the aerosol contents simultaneously stops owing to the design of the aerosol container (which is not the subject matter of this invention).

When the cover member is rotated to an inoperative position, the overhanging flap (28) is positioned above the shelf-like portions (23B) and removed from the distal end of the first bar (6A). Any attempt to further depress the overhanging flap (28) will be resisted by the opposing structure of the shelf-like portion (23B).

Thus, the invention provides an easy to operate, economical cap body for use in association with aerosol containers. In practice, the cover member is fastened to the tubular body at the time of manufacture. The assembled cap body is snap-fastened to the aerosol cap. The terminal end of the second bar (10) fits over the ejection valve stem (14). The depressible portion (26) is rotated to an operative position at which position the overhanging flap (28) is directly above the distal end of the first bar (6A). This position is advantageously marked at the orifice end of the cover member. As explained, when the cover member is rotated to the operative position, the fin (24) in the cover member passes over the corresponding flap (20) on the tubular body, producing an audible sound to signal to the user that the cap is now ready for use. Further, the position is also determined when the stopper (16) resists the rotational movements of the cover member by resisting the further movement of the lip. At the operative position, the free end of the depressible portion (26A) is depressed. According to the preferred configuration, the overhanging flap depresses the distal end of the first bar (6A) causing the second bar (10) to depress the ejection valve stem (14) thus causing the aerosol contents to be released (FIG. 5).

As described earlier when the downward force is removed, the component parts namely, the depressible portion (26), the first bar and the second bar return to their equilibrium position. To bring the cap to the inoperative position, the cover member is now rotated in the opposite direction until further movement is restricted at the moment the stopper (16) restricts the movement of the lip (32). This position is also indicated when the fin (24) passes over the flap (22), resulting in an audible sound. At such position the overhanging flap (28) lies directly above the shelf-like portion (23A).

The cap and the integral components are preferably made of plastics. To the extent not already indicated, it also will be understood by those of ordinary skilled in the art that any one of the various specific embodiments herein described and illustrated may be further modified to incorporate features shown in other of the specific embodiments, as desired.

The invention in its broader aspects therefore is not limited to the specific embodiments herein shown and described but departures may be made therefrom within the scope of the accompanying claims, without departing from the principles of the invention and without sacrificing its chief advantages.

We claim:

1. A cap for aerosol containers embodying a release mechanism, said cap comprising:

a tubular body (1) positioned to cover an ejection valve stem (14) of an aerosol container and having a diametrically positioned first bar (6) pivoted at a proximal end, and a second bar (10) connected to the first bar (6) and positioned and dimensioned to fit over the ejection valve stem (14), the first and second bars having a continuous passage (30) therethrough for allowing flow of contents from said aerosol container into an entrance of the second bar (10) and out through the proximal end of the first bar when a distal end (6A) of the first bar is depressed; and a cover member (2) rotatably mounted over said tubular body (1), for rotating said cover member (2) from an inoperative position to an operative position, and having resilient means with an equilibrium position flush with a top surface of said cover member (2), for engaging on the distal end (6A) of the first bar in the operative position, wherein with said cover member (2) rotated to the operative position an upper portion of the resilient means of said cover member (2) is flush with a top surface of said cover member (2) and said upper portion of the resilient means can be depressed for activating the ejection valve stem thereby releasing contents from said aerosol container, and wherein with said cover member (2) rotated to an inoperative position said upper portion of the resilient means of said cover member (2) is flush with the top surface of said cover member (2) and said upper portion of the resilient means cannot be depressed for activating said ejection valve stem.

2. The cap as set forth in claim 1 wherein said resilient means includes a depressible portion (26) pivotally mounted at one end and actuator means on an underside at a free end of said depressible portion to engage on the distal end (6A) of the first bar (6) in an operative position.

3. The cap as set forth in claim 2 wherein said actuator means includes at least one column (28) perpendicular to the depressible portion and fastened to the underside of the depressible portion (26).

4. The cap as set forth in claim 2 or 3, wherein the tubular body (1) is provided with at least two spaced apart stops (16, 18) and wherein the cover member (2) includes reciprocal abutment means for restricting rotational movement of the cover member (2) on the tubular body within a predetermined radial angle.

5. The cap as set forth in claim 4, wherein, when the first stop (16) and the reciprocal abutment means are in mutual contact, the actuator means is engaged on the distal end (6A) of the first bar (6), and when the second stop (18) and the reciprocal abutment means are in mutual contact, the actuator means is disengaged from the distal end (6A) of the first bar.

6. The cap as set forth in claim 4, wherein the reciprocal abutment means includes a lip (32) projecting inwardly from the circumferential edge of the cover member (2) adjacent to the free end of the depressible portion.

7. The cap as set forth in claim 2, wherein the tubular body includes means to indicate audibly the operative position of the actuator means.

8. The cap according to claim 7, wherein the indicating means also indicates audibly arrival of the cover member (2) in a position corresponding to the inoperative position of the actuator means.

9. The cap as set forth in claim 7 or 8, wherein the indicating means comprises two rigid flap projections (20, 22) spaced apart on the circumferential edge of the tubular body (1), and a corresponding rigid fin (24) projecting on the underside of the inner circumferential edge of the cover member (2) such that the fin (24) on the cover member (2) passes over the flap on the tubular body (1) at the moment the actuator means is at either the operative position or the inoperative position.

10. A cap for an aerosol container comprising:

a tubular body positioned to cover an ejection valve stem of said aerosol container, said tubular body including at least one bar with a duct for releasing contents from said aerosol container, said at least one bar positioned and dimensioned to fit over said ejection valve stem and pivoted at a proximal end, said at least one bar having continuous passage therethrough for allowing flow of contents from said aerosol container into an entrance of said at least one bar and out through the proximal end of said at least one bar when a distal end of said at least one bar is depressed; and a cover member rotatably mounted over said tubular body, for rotating said cover member from an inoperative position to an operative position, and having resilient means for engaging on the distal end of said at least one bar in an operative position, wherein with said cover member rotated to the operative position an upper portion of the resilient means of said cover member is flush with a top surface of said cover member and said upper portion of the resilient means can be depressed for activating said ejection valve stem thereby releasing contents from said aerosol container, and wherein with said cover member rotated to an inoperative position said upper portion of the resilient means of said cover member is flush with the top surface of said cover member and said upper portion of the resilient means cannot be depressed for activating said ejection valve stem.

11. A cap for an aerosol container comprising:

a tubular body positioned to cover an ejection valve stem of said aerosol container, said tubular body including at least one bar with a duct for releasing contents from said aerosol container, said at least one bar positioned and dimensioned to fit over said ejection valve stem and pivoted at a proximal end, said at least one bar having a continuous passage therethrough for allowing flow of contents from said aerosol container into an entrance of said at least one bar and out through the proximal end of said at least one bar when a distal end of said at least one bar is depressed; and a cover member rotatably mounted over said tubular body, for rotating said cover member from an inoperative position to an operative position, and having resilient means for engaging on the distal end of said at least one bar in an operative position, wherein with said cover member rotated to the operative position an upper portion of the resilient means of said cover member is flush with a top surface of said cover member and said upper portion of the resilient means can be depressed for activating said ejection valve stem thereby releasing contents from said aerosol container, and wherein with said cover member rotated to an inoperative position said upper portion of the resilient means of said cover member is flush with the top surface of said cover member and said upper portion of the resilient means cannot be depressed for activating said ejection valve stem, and wherein said resilient means includes a depressible portion pivotally mounted at one end and actuator means on an underside at a free end of said depressible portion to engage on the distal end of said at least one bar in an operative position.

12. The cap as set forth in claim 11 wherein said actuator means includes at least one column perpendicular to the depressible portion and fastened to the underside of the depressible portion.

13. The cap as set forth in claim 11 or 12, wherein the tubular body is provided with at least two spaced apart stops and wherein the cover member includes reciprocal abutment means for restricting rotational movement of the cover member on the tubular body within a predetermined radial angle.

14. The cap as set forth in claim 13, wherein, when the first stop and the reciprocal abutment means are in mutual contact, the actuator means is engaged on the distal end of said at least one bar, and when the second stop and the reciprocal abutment means are in mutual contact, the actuator means is disengaged from the distal end of said at least one bar.

15. The cap as set forth in claim 13, wherein the reciprocal abutment means includes a lip projecting inwardly from the circumferential edge of the cover member adjacent to the free end of the depressible portion.

16. The cap as set forth in claim 11, wherein said cap includes means to indicate audibly the operative position of the actuator means.

17. The cap according to claim 16, wherein the indicating means also indicates audibly arrival of the cover member in a position corresponding to the inoperative position of the actuator means.

18. The cap as set forth in claim 16 or 17, wherein the indicating means comprises two rigid flap projections spaced apart on the circumferential edge of the tubular body, and a corresponding rigid fin projecting on the underside of the inner circumferential edge of the cover member such that the fin on the cover member passes over the flap on the tubular body at the moment the actuator means is at either the operative position or the inoperative position.

19. A cap for an aerosol container comprising:

a tubular body positioned to cover an ejection valve stem of said aerosol container, said tubular body including at least one bar with a duct for releasing contents from said aerosol container, said at least one bar positioned and dimensioned to fit over said ejection valve stem and pivoted at a proximal end, said at least one bar having a continuous passage therethrough for allowing flow of contents from said aerosol container into an entrance of said at least one bar and out through the proximal end of said at least one bar when a distal end of said at least one bar is depressed; and a cover member rotatably mounted over said tubular body, for rotating said cover member from an inoperative position to an operative position, and having resilient means for engaging on the distal end of said at least one bar in an operative position, wherein with said cover member rotated to the operative position an upper position of the resilient means of said cover member is flush with a surface of said cover member and said upper portion of the resilient means can be depressed for activating said ejection valve stem thereby releasing contents from said aerosol container.

20. A cap for an aerosol container comprising:

a tubular body positioned to cover an ejection valve stem of said aerosol container, said tubular body including at least one bar with a duct for releasing contents from said aerosol container, said at least one bar positioned and dimensioned to fit over said ejection valve stem and pivoted at a proximal end, said at least one bar having a continuous passage therethrough for allowing flow of contents from said aerosol container into an entrance of said at least one bar and out through the proximal end of said at least one bar when a distal end of said at least one bar is depressed; and a cover member rotatably mounted over said tubular body, for rotating said cover member from an inoperative position to an operative position, and having resilient means for engaging on the distal end of said at least one bar in an operative position, wherein with said cover member rotated to the operative position an upper position of the resilient means of said cover member is flush with a surface of said cover member and said upper portion of the resilient means can be depressed for activating said ejection valve stem thereby releasing contents from said aerosol container, and wherein said resilient means includes a depressible portion pivotally mounted at one end and actuator means on an underside at a free end of said depressible portion to engage on the distal end of said at least one bar in an operative position.

21. The cap as set forth in claim 20 wherein said actuator means includes at least one column perpendicular to the depressible portion and fastened to the underside of the depressible portion.

22. The cap as set forth in claims 20 or 21, wherein the tubular body is provided with at least two spaced apart stops and wherein the cover member includes reciprocal abutment means for restricting rotational movement of the cover member on the tubular body within a predetermined radial angle.

23. The cap as set forth in claim 22, wherein, when the first stop and the reciprocal abutment means are in mutual contact, the actuator means is engaged on the distal end of said at least one bar, and when the second stop and the reciprocal abutment means are in mutual contact, the actuator means is disengaged from the distal end of said at least one bar.

24. The cap as set forth in claim 22, wherein the reciprocal abutment means includes a lip projecting inwardly from the circumferential edge of the cover member adjacent to the free end of the depressible portion.

25. The cap as set forth in claim 20 wherein said cap includes means to indicate audibly the operative position of the actuator means.

26. The cap according to claim 25, wherein the indicating means also indicates audibly arrival of the cover member in a position corresponding to the inoperative position of the actuator means.

27. The cap as set forth in claim 25 or 26, wherein the indicating means comprises two rigid flap projections spaced apart on the circumferential edge of the tubular body, and a corresponding rigid fin projecting on the underside of the inner circumferential edge of the cover member such that the fin on the cover member passes over the flap on the tubular body at the moment the actuator means is at either the operative position or the inoperative position.

* * * * *